US010982922B2

(12) United States Patent
Burke

(10) Patent No.: US 10,982,922 B2
(45) Date of Patent: Apr. 20, 2021

(54) DEVICES, SYSTEMS, AND METHODS FOR MODIFYING FIREARMS

(71) Applicant: NRB Development, LLC, Aurora, CO (US)

(72) Inventor: Eric Burke, Centennial, CO (US)

(73) Assignee: NRB Development, LLC, Aurora, CO (US)

( * ) Notice: Subject to any disclaimer, the term of this patent is extended or adjusted under 35 U.S.C. 154(b) by 100 days.

(21) Appl. No.: 16/447,115

(22) Filed: Jun. 20, 2019

(65) Prior Publication Data

US 2020/0400399 A1 Dec. 24, 2020

(51) Int. Cl.
*F41A 21/48* (2006.01)
*F41A 11/02* (2006.01)

(52) U.S. Cl.
CPC ..... *F41A 21/482* (2013.01); *F41A 11/02* (2013.01)

(58) Field of Classification Search
CPC ..... F41A 21/482; F41A 21/487; F41A 21/48; F41A 11/02
See application file for complete search history.

(56) References Cited

U.S. PATENT DOCUMENTS 5,410,834 A 5/1995 Benton et al.
5,987,797 A 11/1999 Dustin
6,671,990 B1 1/2004 Booth
6,694,660 B1 2/2004 Davies
7,076,904 B1 * 7/2006 Rustick ..... F41A 21/482 42/75.01
7,451,564 B2 11/2008 Wait
9,239,203 B2 1/2016 Jarboe et al.
2005/0066951 A1 * 3/2005 Seekman ..... F41B 11/62 124/56
2007/0186458 A1 8/2007 Wait
2008/0178510 A1 7/2008 Paasikivi et al.
2014/0075817 A1 * 3/2014 Gomez ..... F16B 37/00 42/75.02
2017/0160037 A1 * 6/2017 Gray ..... F41A 21/482
2019/0086175 A1 * 3/2019 Karagias ..... F41A 21/482

FOREIGN PATENT DOCUMENTS

EP 0164351 B1 12/1985
EP 2665982 B1 11/2013

* cited by examiner

*Primary Examiner* — J. Woodrow Eldred
(74) *Attorney, Agent, or Firm* — Faegre Drinker Biddle & Reath LLP

(57) ABSTRACT

A kit for modifying a firearm includes an adapter, and the adapter includes an external threaded surface configured to detachably couple to an internal threaded surface of a receiver of the firearm. An adapter bore is disposed opposite the external threaded surface, and the adapter bore is configured to receive a barrel of the firearm. The kit further includes a securing element, and the securing element includes a securing element bore configured to receive the barrel. The securing element is configured to detachably couple to the adapter and thereby secure the barrel to the adapter.

14 Claims, 10 Drawing Sheets

DEVICES, SYSTEMS, AND METHODS FOR MODIFYING FIREARMS

CROSS-REFERENCE TO RELATED APPLICATION

Not applicable.

TECHNICAL FIELD

The present disclosure generally relates to devices, systems, and methods for modifying firearms. More specifically, the present disclosure relates to devices, systems, and methods for modifying bolt action rifles to receive barrels of different calibers, lengths, and/or contours.

BACKGROUND

Different types and sizes of firearms are designed to receive and discharge ammunition of different sizes, and therefore are suitable for different types of activities. For example, relatively light-caliber firearms may be used for target shooting, and relatively heavy-caliber firearms may be used for hunting or defense. However, owning a different firearm for each of these different activities can be prohibitively expensive for most people. Accordingly, there is a continuing need for improvements to firearms.

SUMMARY

A kit for modifying a firearm according to an embodiment of the present disclosure includes an adapter, and the adapter includes an external threaded surface configured to detachably couple to an internal threaded surface of a receiver of the firearm. An adapter bore is disposed opposite the external threaded surface, and the adapter bore is configured to receive a barrel of the firearm. The kit further includes a securing element, and the securing element includes a securing element bore configured to receive the barrel. The securing element is configured to detachably couple to the adapter and thereby secure the barrel to the adapter.

A kit as described hereinabove, wherein the adapter further includes a first coupling feature, and the securing element further includes a second coupling feature configured to detachably couple to the first coupling feature and thereby secure the barrel to the adapter.

A kit as described hereinabove, wherein the external threaded surface of the adapter is a first external threaded surface, the first coupling feature of the adapter is a second external threaded surface, and the second coupling feature of the securing element is an internal threaded surface.

A kit as described hereinabove, wherein the adapter bore includes an unthreaded surface configured to engage the barrel.

A kit as described hereinabove, wherein the adapter further includes an adapter flange configured to engage a recoil lug of the firearm.

A kit as described hereinabove, wherein the securing element further includes a mounting surface configured to detachably couple to a hand guard.

A kit as described hereinabove, wherein the external threaded surface of the adapter is a first external threaded surface, and the mounting surface of the securing element is a second external threaded surface.

A kit for modifying a firearm according to an embodiment of the present disclosure includes an adapter, and the adapter includes a first external threaded surface configured to detachably couple to an internal threaded surface of a receiver of the firearm; a second external threaded surface; and an adapter bore disposed opposite the first external threaded surface and second external threaded surface. The kit further includes a barrel, and the barrel includes a coupling portion having an unthreaded surface configured to be received in the adapter bore; and a flange configured to engage the adapter when the unthreaded surface is received in the adapter bore. The barrel further includes a barrel bore configured to receive ammunition from the receiver and discharge the ammunition from the barrel. The kit further includes a securing element having a securing element bore configured to receive the barrel; and an internal threaded surface disposed within the securing element bore, the internal threaded surface being configured to detachably couple to the second external threaded surface of the adapter. The securing element engages the flange of the barrel when the internal threaded surface couples to the second external threaded surface of the adapter, and the securing element thereby secures the barrel to the adapter.

A kit as described hereinabove, wherein the securing element further includes a shoulder disposed within the securing element bore, wherein the shoulder engages the flange of the barrel when the internal threaded surface couples to the second external threaded surface of the adapter and thereby secures the barrel to the adapter.

A kit as described hereinabove, wherein the adapter includes a first engagement feature, and the flange of the barrel includes a second engagement feature configured to engage the first engagement feature.

A kit as described hereinabove, wherein the first engagement feature includes one of a protrusion and a recess and the second engagement feature includes the other of a protrusion and a recess.

A kit as described hereinabove, wherein the first engagement feature includes a protrusion and the second engagement feature includes a recess.

A kit as described hereinabove, wherein the first external threaded surface includes a first diameter, the second external threaded surface includes a second diameter, the second diameter being greater than the first diameter.

A kit as described hereinabove, wherein the securing element further includes a mounting surface configured to detachably couple to a hand guard.

A barrel for modifying a firearm according to an embodiment of the present disclosure includes a coupling portion, and the coupling portion includes an unthreaded surface configured to be received in an adapter bore of an adapter for the firearm. The unthreaded surface has a diameter of substantially 0.846 inches. The barrel further includes a barrel bore configured to receive ammunition from the receiver and discharge the ammunition from the barrel.

A barrel as described herein above, wherein the coupling portion further includes a flange configured to engage the adapter when the unthreaded surface is received in the adapter bore.

BRIEF DESCRIPTION OF THE DRAWINGS

The accompanying drawings are incorporated into and form a part of the specification to illustrate one or more examples of the present disclosure, to include one or more embodiments as described herein. These drawings, together with the description, explain the principles of the disclosure. The drawings simply illustrate preferred and alternative examples of how the embodiments may be made and used and are not to be construed as limiting the disclosure to only the illustrated and described exemplary embodiments. Further features and advantages will become apparent from the following, more detailed, description of the various aspects and embodiments of the disclosure, as illustrated by the drawings referenced below.

Figure 1:
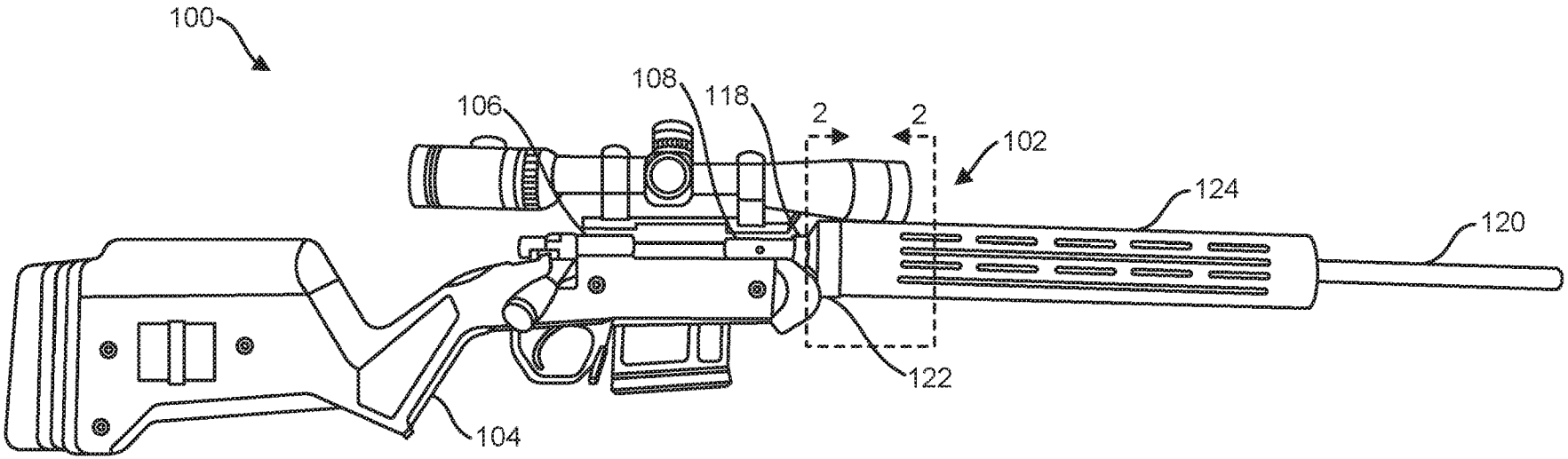
FIG. 1 illustrates a side view of a firearm including components of a modification kit according to an embodiment of the present disclosure.

Corresponding reference characters indicate corresponding parts throughout the several views. It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof, as well as additional items.

Devices, systems, and methods according to embodiments of the present disclosure facilitate reconfiguring firearms, such as bolt action rifles, to receive barrels of different calibers, lengths, and/or contours. Accordingly, devices, systems, and methods according to embodiments of the present disclosure facilitate reconfiguring firearms for suitability for different types of activities.

Figure 2:
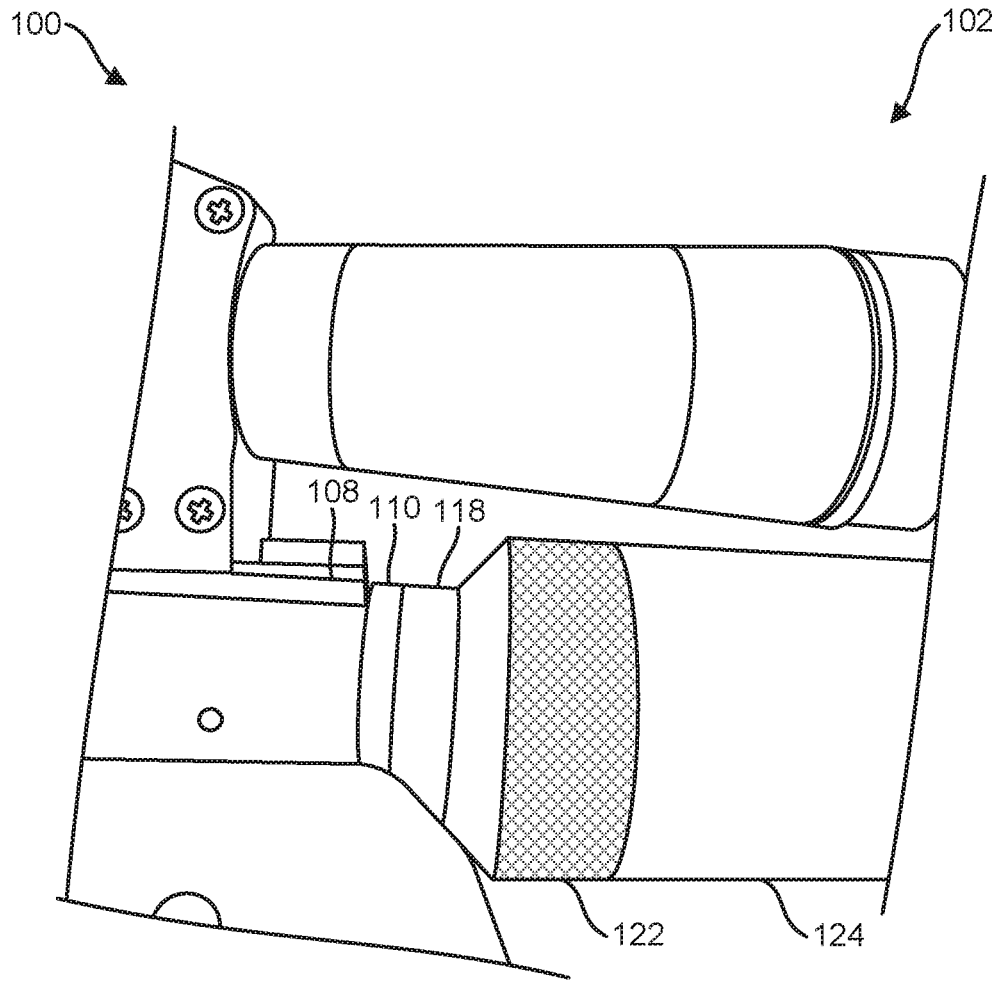
FIG. 2 illustrates a detail view of the firearm and the modification kit within line 2-2 of FIG. 1.
Figure 3:
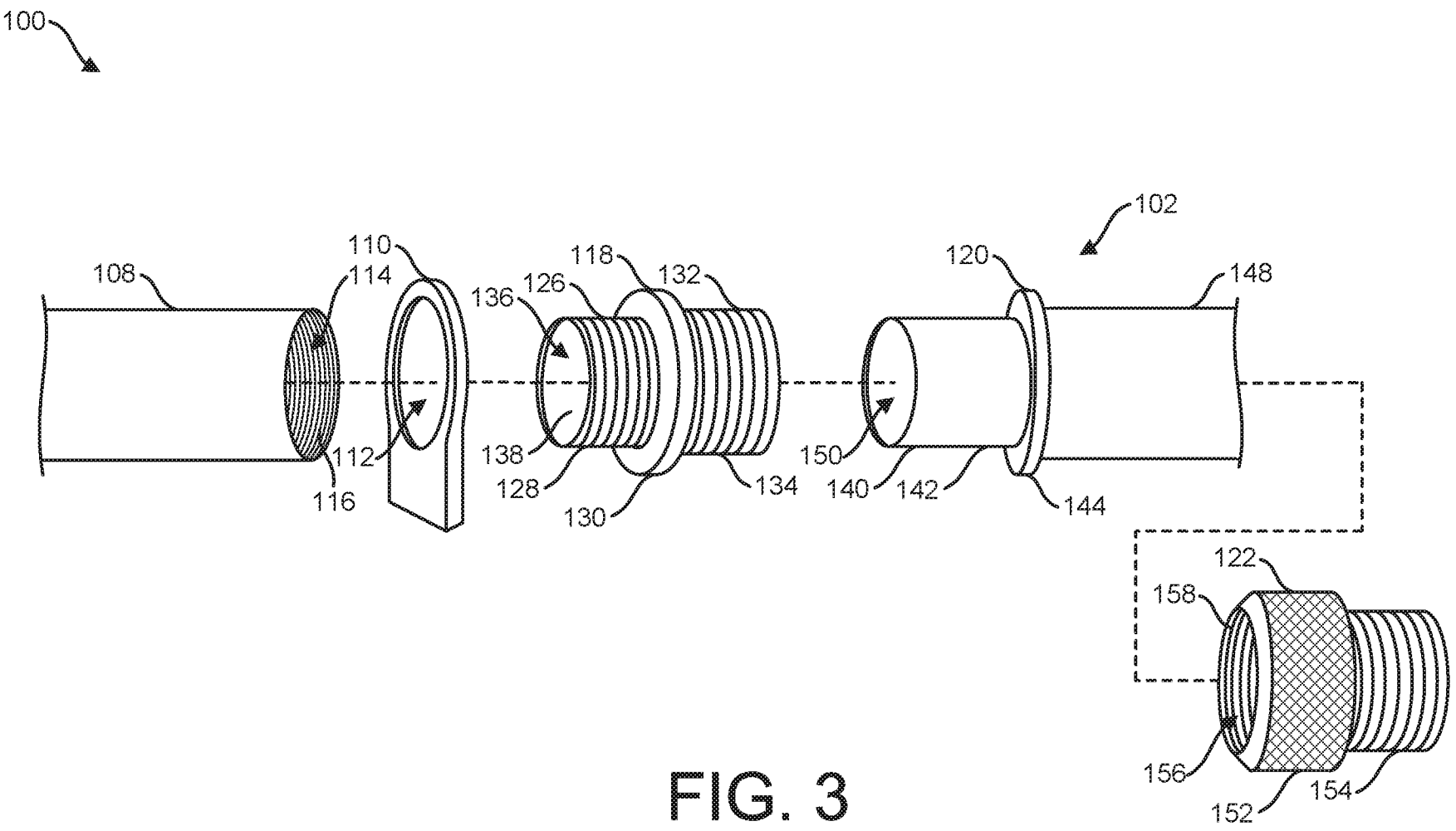
FIG. 3 illustrates an exploded partial view of the firearm and the modification kit of FIG. 1.

FIGS. 1-3 illustrate a firearm 100 including components of a modification kit 102 according to an embodiment of the present disclosure. Generally, the firearm 100 includes a stock 104 that carries an action 106, a receiver 108, and a recoil lug 110. The recoil lug 110 includes a recoil lug bore 112 through which the modification kit 102 extends. The receiver 108 includes a receiver bore 114 (shown specifically in FIG. 3), and the receiver bore 114 includes an internal threaded surface 116 for coupling to the modification kit 102. The stock 104, action 106, receiver 108, and the recoil lug 110 may be, for example, components of any of various commercially available takedown rifles. More specifically, the stock 104, action 106, receiver 108, and recoil lug 110 may be components of any of various commercially available takedown bolt action rifles, as illustrated, although such components may alternatively take other forms.

The modification kit 102 detachably couples to the receiver 108 and, as a result, the action 106 and the stock 104. Generally, the modification kit 102 includes an adapter 118 that detachably couples to the receiver 108, a barrel 120 that detachably couples to the adapter 118, and a securing element 122 that detachably couples to the adapter 118 and thereby selectively secures the barrel 120 to the adapter 118 and the receiver 108 and, as a result, the action 106 and the stock 104. In some embodiments, the securing element 122 may also detachably couple to one or more accessories, such as a hand guard 124 as illustrated. Further details of the components of the modification kit 102 are provided in the following paragraphs.

Figure 4:
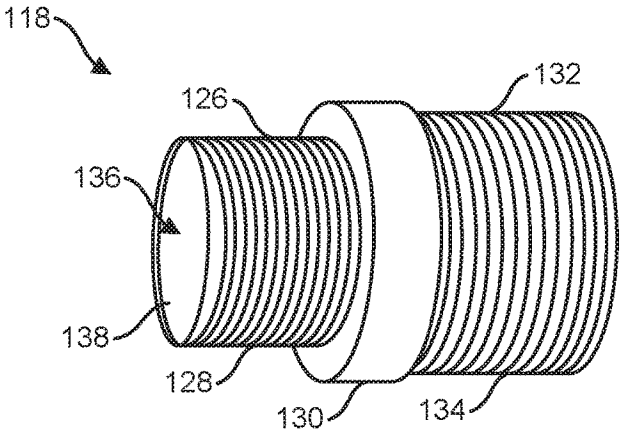
FIG. 4 illustrates a perspective view of an adapter of the modification kit of FIG. 1.

Referring specifically to FIGS. 3 and 4, the adapter 118 is a generally cylindrical component that may be formed, for example, of one or more metals. The adapter 118 includes a first end portion 126 that is configured to extend through the recoil lug bore 112. The first end portion 126 includes a first external threaded surface 128 that is configured to detachably couple to the internal threaded surface 116 of the receiver 108. The first external threaded surface 128 may have appropriate dimensions (for example, diameter, pitch, thread angle, and the like) to facilitate threadably coupling with the internal threaded surface 116 of the receiver 108. Adjacent the first end portion 126, the adapter 118 further includes an adapter flange 130. The adapter flange 130 has a relatively large diameter compared to the first end portion 126. The adapter flange 130 is configured to engage the recoil lug 110 of the firearm 100 and facilitate positioning of the adapter 118 relative to the receiver 108. Adjacent the adapter flange 130 and opposite the first end portion 126, the adapter 118 further includes a second end portion 132. The second end portion 132 includes a first coupling feature 134 for detachably coupling to the securing element 122. In some embodiments and as illustrated, the first coupling feature 134 may be a second external threaded surface 134. The second external threaded surface 134 may have a different diameter than the first external threaded surface 128 depending on, for example, the size of the receiver 108 and the size of the barrel 120. In some embodiments and as illustrated, the second external threaded surface 134 may have a larger diameter than the first external threaded surface 128. The second end portion 132 also includes a first engagement feature (shown elsewhere) that engages the barrel 120 to facilitate consistent radial positioning of the barrel 120 relative to the receiver 108. Opposite the first external threaded surface 128 and the second external threaded surface 134 (that is, internally within the adapter 118), the adapter 118 further includes an adapter bore 136. The adapter bore 136 extends through from the first end portion 126 to the second end portion 132 of the adapter 118. The adapter bore 136 is configured to receive the barrel 120. In some embodiments and as illustrated, the adapter bore 136 comprises an unthreaded surface 138 configured to engage the barrel 120.

In some embodiments, the kit 102 may include one or more additional adapters that detachably couple to receivers having different sizes and/or thread characteristics. Accordingly, the one or more additional adapters may facilitate coupling the barrel and the securing element to various different firearms.

Figure 5:
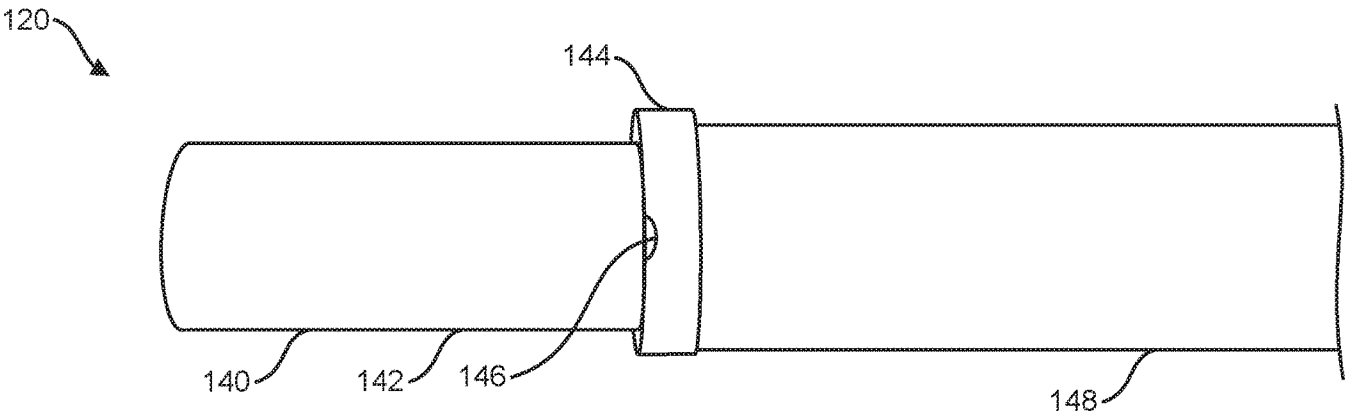
FIG. 5 illustrates a side view of a barrel of the modification kit of FIG. 1.

Referring specifically to FIGS. 3 and 5, the barrel 120 is a tapering generally cylindrical component that may be formed, for example, of one or more metals. The barrel 120 includes a first end or coupling portion 140 that is configured to be received in the adapter bore 136. In some embodiments and as illustrated, the coupling portion 140 includes an unthreaded surface 142 that is configured to be slidably received by the unthreaded surface 138 of the adapter bore 136. The unthreaded surface 142 may have a diameter of substantially 0.846 inches (that is, 0.846 inches±0.01 inches). The unthreaded surface 142 may have a length of substantially 2.029 inches (that is, 2.029 inches±0.01 inches). The coupling portion 140 further includes a barrel flange 144. The barrel flange 144 has a relatively large diameter compared to the unthreaded surface 142. The barrel flange 144 may have a radius that is substantially 0.130 inches (that is, 0.130 inches±0.01 inches) greater than the radius of the unthreaded surface 142. The barrel flange 144 may have a length of substantially 0.246 inches (that is, 0.246 inches±0.01 inches). The barrel flange 144 is configured to engage the adapter 118 when the unthreaded surface 142 is received in the adapter bore 136. The barrel flange 144 includes a second engagement feature 146 that engages the first engagement feature of the adapter 118. In some embodiments, the second engagement feature 146 may be a recess 146 (as illustrated) and the first engagement feature may be a protrusion (shown elsewhere). The recess 146 may have a width of about 0.180 inches (that is, 0.180 inches±0.01 inches). In other embodiments, the second engagement feature 146 may be a protrusion and the first engagement feature may be a recess. Opposite the coupling portion 140, the barrel 120 further includes a second or ammunition discharging end portion 148. Internally, the barrel 120 includes a barrel bore 150 that is configured to receive ammunition (not shown) from the receiver 108 and direct the ammunition therethrough.

In some embodiments, the kit 102 may include one or more additional barrels that detachably couple to the adapter and have a different caliber, length, and/or contour than other barrels in the kit. In some embodiments, a user may separately obtain one or more additional barrels that detachably couple to the adapter and have a different caliber, length, and/or contour. In any case, a user may reconfigure the firearm 100 to include a barrel suitable for a specific activity.

Figure 6:
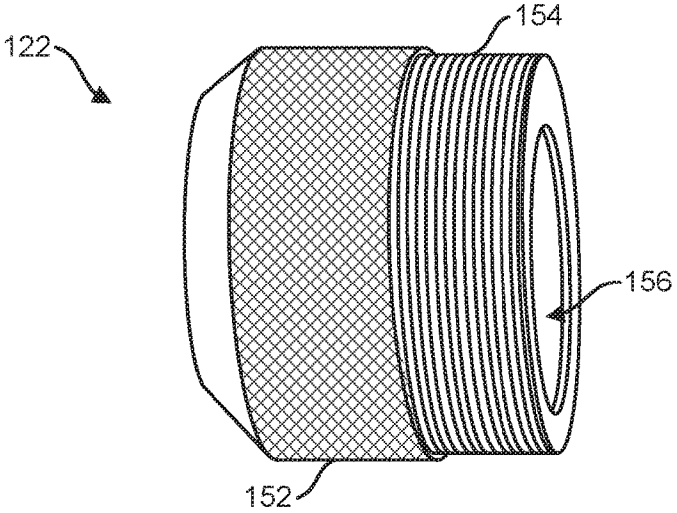
FIG. 6 illustrates a perspective view of a securing element of the modification kit of FIG. 1.

Referring specifically to FIGS. 3 and 6, the securing element 122 is a generally cylindrical component that may be formed, for example, of one or more metals. Externally, the securing element 122 includes a gripping surface 152 that facilitates rotating and coupling the securing element 122 to the adapter 118. In some embodiments and as illustrated, the gripping surface 152 may include a knurling pattern. The securing element 122 further includes a mounting surface 154 that is configured to detachably couple the securing element 122 to one or more accessories, such as the hand guard 124. In some embodiments and as illustrated, the mounting surface 154 is an external threaded surface 154. Internally, the securing element 122 includes a securing element bore 156 that extends therethrough. The securing element 122 is configured to be positioned around the barrel 120 by receiving the barrel 120 in the securing element bore 156. The securing element bore 156 also includes a second coupling feature 158. The second coupling feature 158 is configured to detachably couple to the first coupling feature 134 of the adapter 118 and thereby secure the barrel 120 to the adapter 118. In some embodiments and as illustrated, the second coupling feature 158 is an internal threaded surface 158. The internal threaded surface 158 may have appropriate dimensions (for example, diameter, pitch, thread angle, and the like) to facilitate threadably engaging the second external threaded surface 134 of the adapter 118. The securing element 122 further includes a shoulder (shown elsewhere) disposed within the securing element bore 156. The shoulder engages the flange of the barrel 120 when the internal threaded surface 158 couples to the second external threaded surface 134 of the adapter 118 and thereby secures the barrel 120 to the adapter 118.

Figure 7:
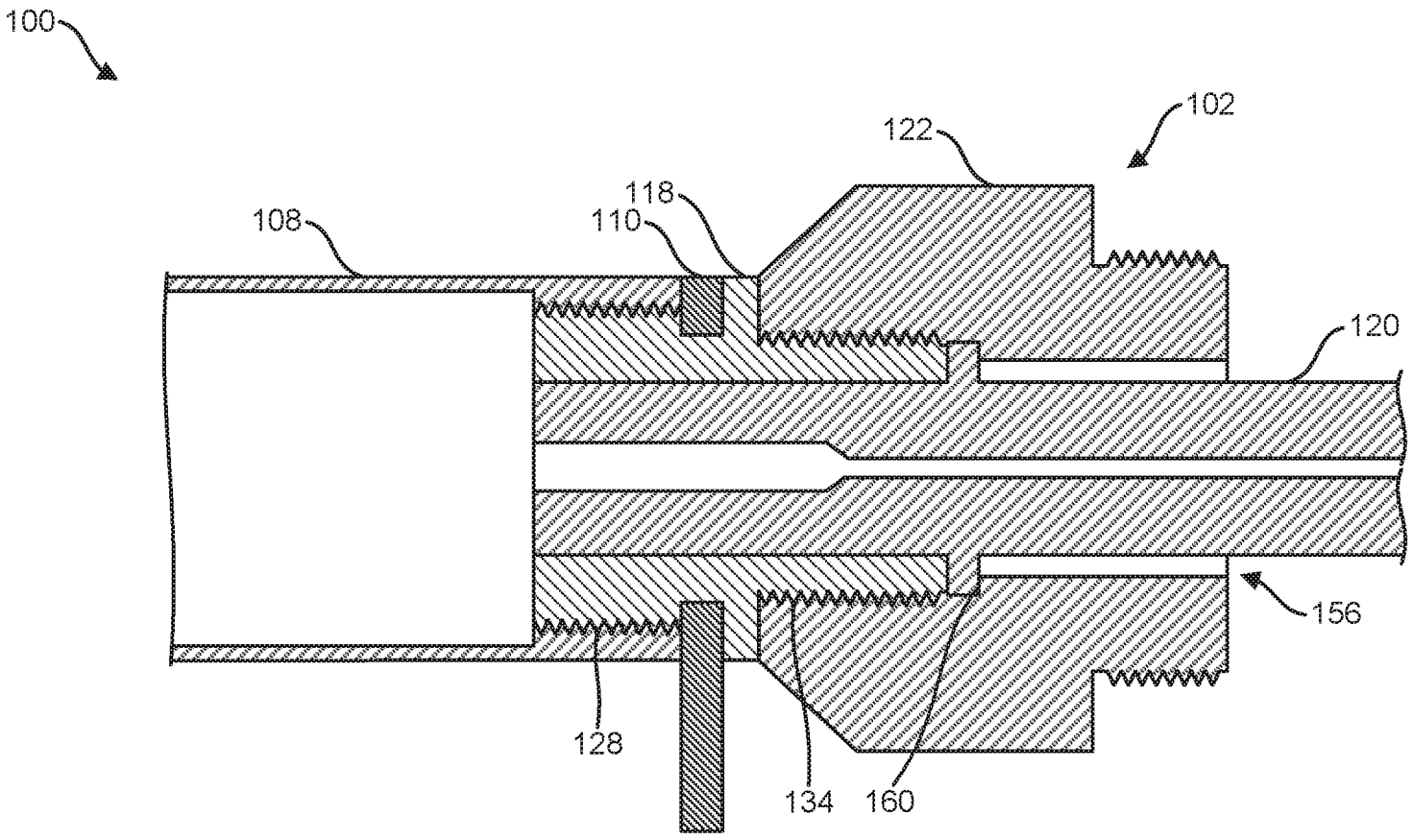
FIG. 7 illustrates a transverse section view of the firearm and the modification kit of FIG. 1.

FIG. 7 illustrates a transverse section view of the firearm 100 and the modification kit 102. Generally, the receiver 108, the recoil lug 110, the adapter 118, the barrel 120, and the securing element 122 are illustrated. The shoulder 160 disposed within the securing element bore 156 is also illustrated. In addition and in contrast to the other figures, FIG. 7 illustrates the first external threaded surface 128 as having a smaller diameter than the second external threaded surface 134.

Figure 8:
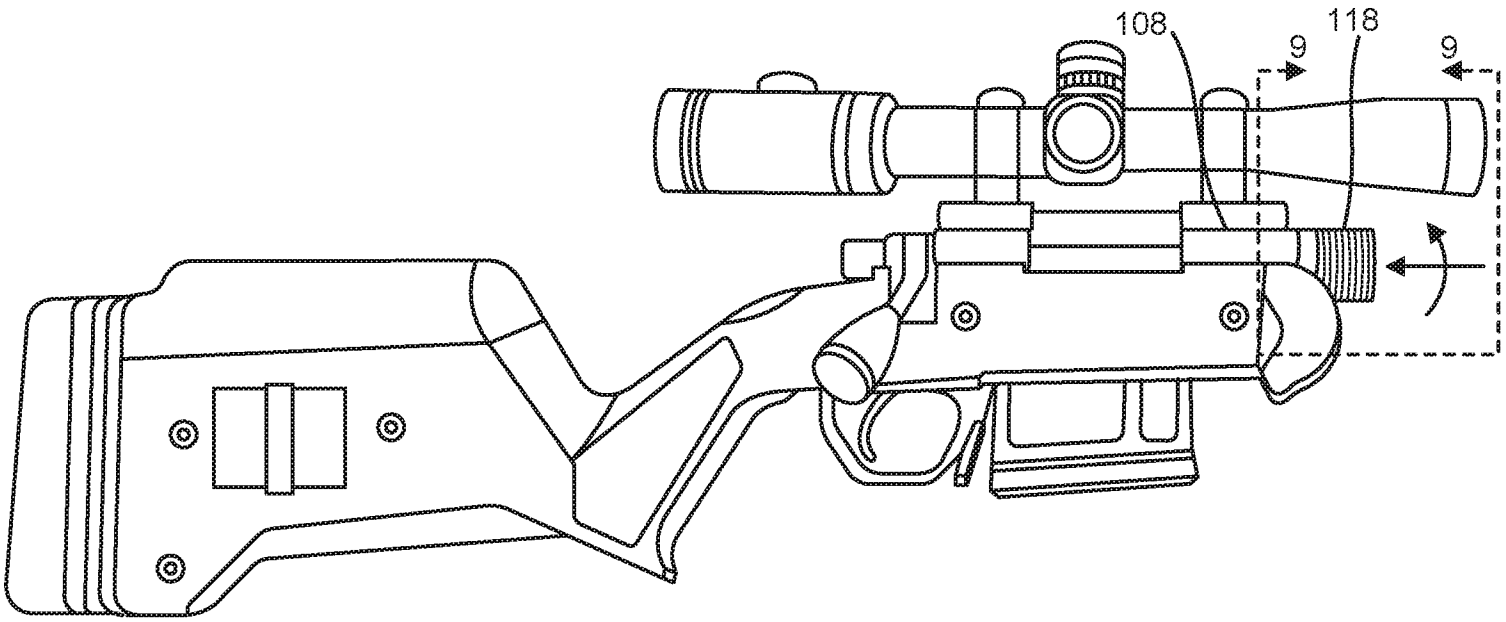
FIGS. 8-12 illustrate an exemplary method for assembling a firearm according to an embodiment of the present disclosure.
Figure 9:
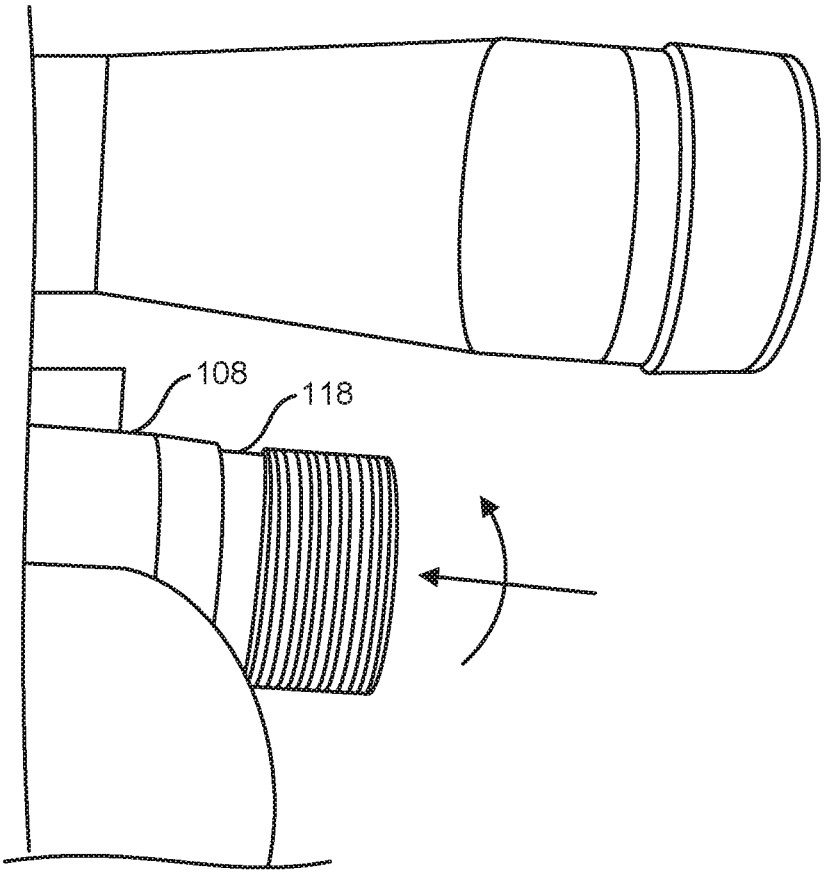
Figure 10:
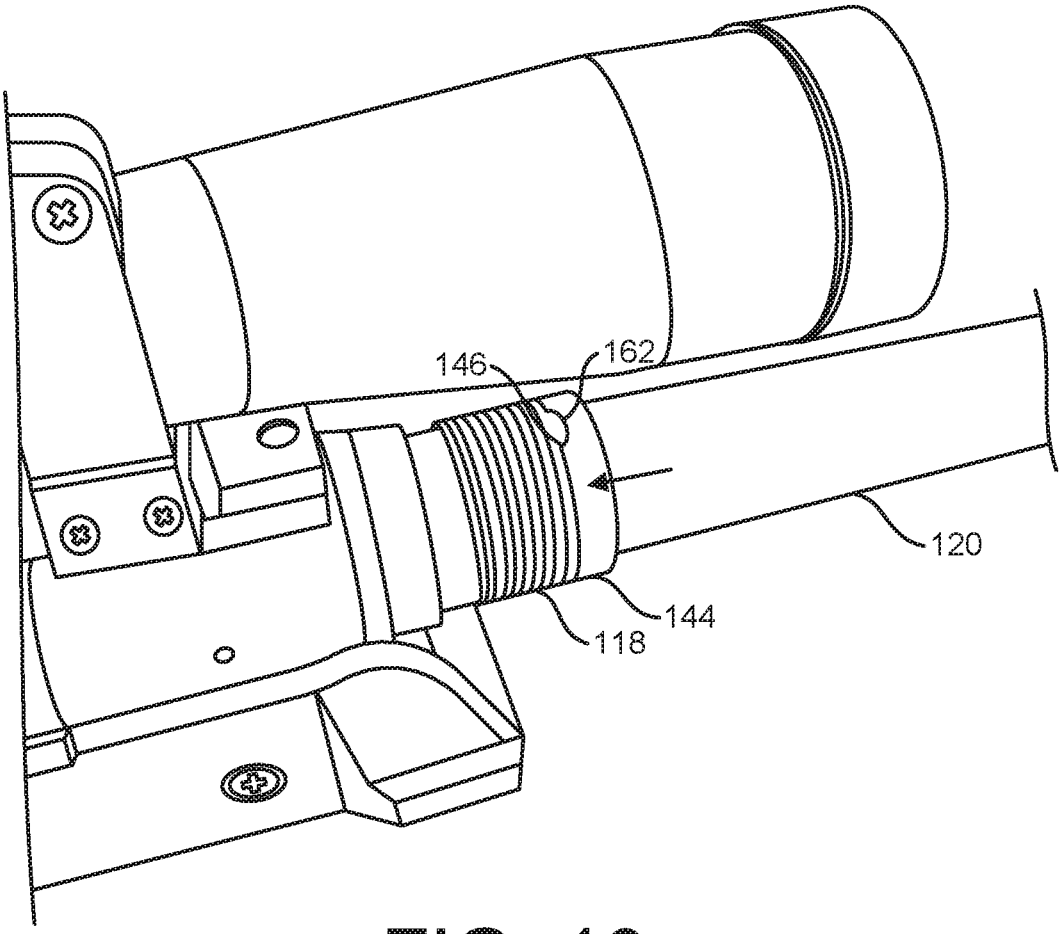
Figure 11:
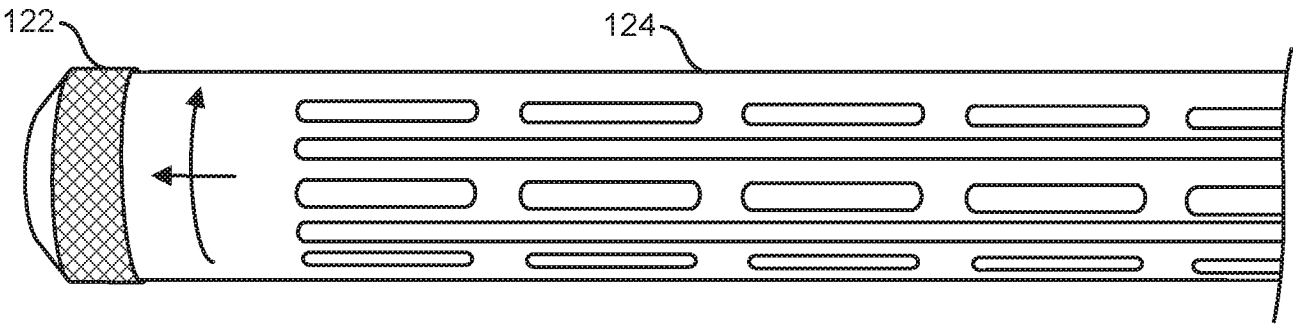
Figure 12:
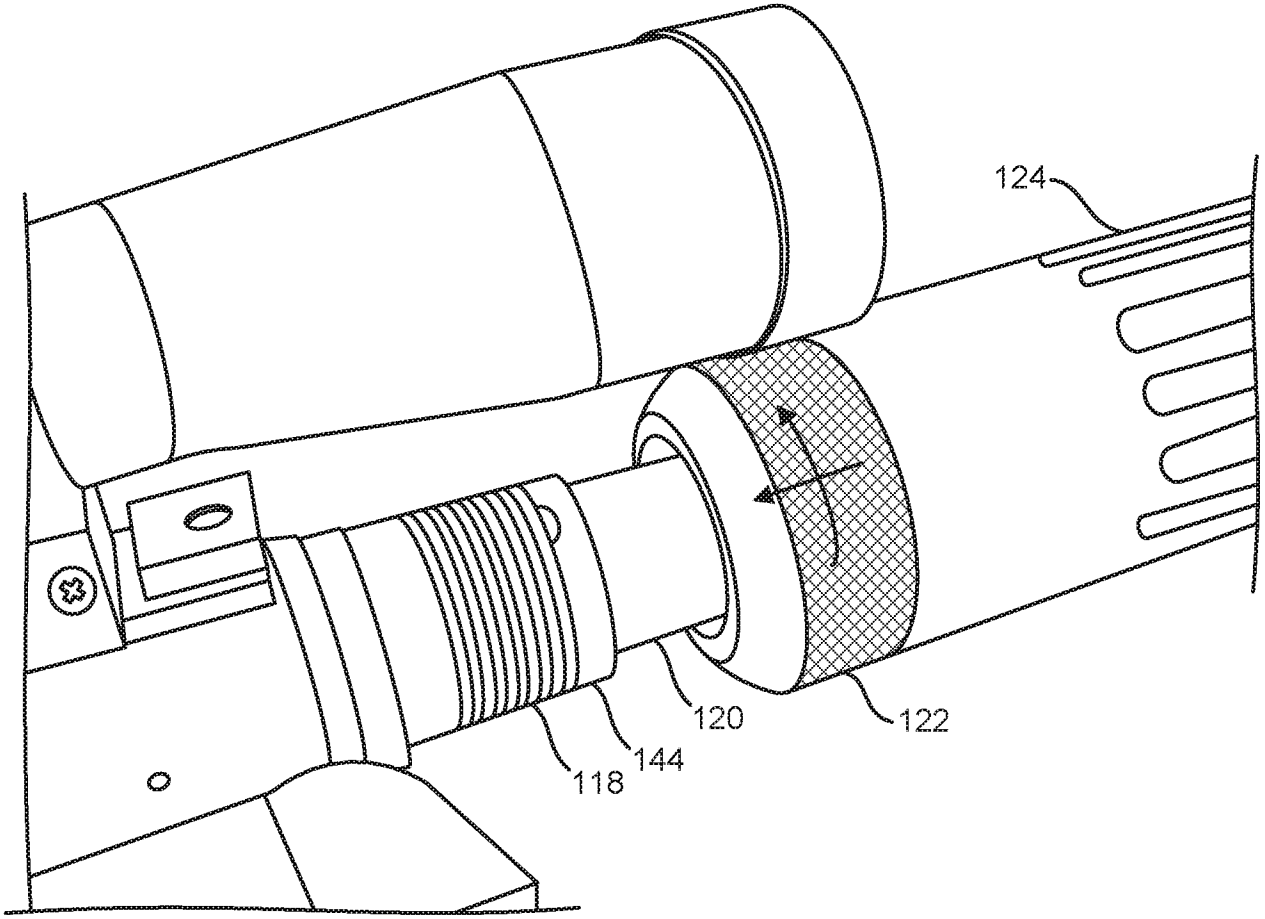

FIGS. 8-12 illustrate an exemplary method for assembling a firearm according to an embodiment of the present disclosure. As shown in FIGS. 8 and 9, the method begins by coupling the adapter 118 to the receiver 108. More specifically, the adapter 118 is rotated relative to the receiver 108 such that the first external threaded surface 128 of the adapter 118 (see FIG. 3) threadably couples with the internal threaded surface 116 of the receiver 108. Next and as shown in FIG. 10, the barrel 120 is coupled to the adapter 118. More specifically, the unthreaded surface 142 of the coupling portion 140 of the barrel 120 (see FIG. 3) is slidably received by the unthreaded surface 138 of the adapter bore 136. In addition, the protrusion 162 of the adapter 118 is received in the recess 146 of the barrel flange 144. As shown in FIG. 11, an accessory, such as the hand guard 124, may be coupled to the securing element 122. More specifically, the accessory is rotated relative to the securing element 122 such that an internal threaded surface of the accessory (not shown) threadably couples with the external threaded surface of the securing element 122. Next and as shown in FIG. 12, the securing element 122 is positioned on the barrel 120 and coupled to the adapter 118. More specifically, the securing element 122 is advanced over the barrel 120 and the securing element 122 is rotated relative to the barrel 120 and the adapter 118 such that the internal threaded surface 158 of the securing element 122 (see FIG. 3) threadably couples with the second external threaded surface 134 of the adapter 118. This action causes the shoulder 160 of the securing element 122 (see FIG. 7) to engage the flange 144 of the barrel 120 and thereby secure the barrel 120 to the adapter 118. The firearm 100 may be disassembled in the opposite manner and reconfigured by assembling the firearm 100 with a barrel having a different caliber, length, and/or contour.

Devices, systems, and methods according to embodiments of the present disclosure may take various alternative forms. For example, one or more of the coupling features could include unthreaded surfaces and separate fasteners, such set screws, to provide selective securement.

Various embodiments have been described, which are intended in all respects to be illustrative rather than restrictive. Alternative embodiments will become apparent to those of ordinary skill in the art to which the present disclosure pertains without departing from its scope. It will be understood that certain features and subcombinations are of utility and may be employed without reference to other features and subcombinations.

The following is claimed:

1. A kit for modifying a firearm, the kit comprising:

an adapter comprising:

an external threaded surface configured to detachably couple to an internal threaded surface of a receiver of the firearm;

an adapter bore disposed opposite the external threaded surface, the adapter bore configured to receive a barrel of the firearm; and a securing element comprising a securing element bore configured to receive the barrel, wherein the securing element is configured to detachably couple to the adapter and thereby secure the barrel to the adapter.

2. The kit of claim 1, wherein the adapter further comprises a first coupling feature, and the securing element further comprises a second coupling feature configured to detachably couple to the first coupling feature and thereby secure the barrel to the adapter.

3. The kit of claim 2, wherein the external threaded surface of the adapter is a first external threaded surface, the first coupling feature of the adapter is a second external threaded surface, and the second coupling feature of the securing element is an internal threaded surface.

4. The kit of claim 1, wherein the adapter bore comprises an unthreaded surface configured to engage the barrel.

5. The kit of claim 1, wherein the adapter further comprises an adapter flange configured to engage a recoil lug of the firearm.

6. The kit of claim 1, wherein the securing element further comprises a mounting surface configured to detachably couple to a hand guard.

7. The kit of claim 6, wherein the external threaded surface of the adapter is a first external threaded surface, and the mounting surface of the securing element is a second external threaded surface.

8. A kit for modifying a firearm, the kit comprising:

an adapter comprising:

a first external threaded surface configured to detachably couple to an internal threaded surface of a receiver of the firearm;

a second external threaded surface;

an adapter bore disposed opposite the first external threaded surface and second external threaded surface;

a barrel comprising:

a coupling portion comprising:

an unthreaded surface configured to be received in the adapter bore;

a flange configured to engage the adapter when the unthreaded surface is received in the adapter bore;

a barrel bore configured to receive ammunition from the receiver and discharge the ammunition from the barrel;

a securing element comprising:

a securing element bore configured to receive the barrel; and an internal threaded surface disposed within the securing element bore, the internal threaded surface being configured to detachably couple to the second external threaded surface of the adapter;

wherein the securing element engages the flange of the barrel when the internal threaded surface couples to the second external threaded surface of the adapter, the securing element thereby securing the barrel to the adapter.

9. The kit of claim 8, wherein the securing element further comprises a shoulder disposed within the securing element bore, wherein the shoulder engages the flange of the barrel when the internal threaded surface couples to the second external threaded surface of the adapter and thereby secures the barrel to the adapter.

10. The kit of claim 8, wherein the adapter comprises a first engagement feature, and the flange of the barrel comprises a second engagement feature configured to engage the first engagement feature.

11. The kit of claim 10, wherein the first engagement feature comprises one of a protrusion and a recess and the second engagement feature comprises the other of a protrusion and a recess.

12. The kit of claim 10, wherein the first engagement feature comprises a protrusion and the second engagement feature comprises a recess.

13. The kit of claim 8, wherein the first external threaded surface comprises a first diameter, the second external threaded surface comprises a second diameter, the second diameter being greater than the first diameter.

14. The kit of claim 8, wherein the securing element further comprises a mounting surface configured to detachably couple to a hand guard.

* * * * *